US006982676B2

(12) United States Patent
Sievenpiper et al.

(10) Patent No.: US 6,982,676 B2
(45) Date of Patent: Jan. 3, 2006

(54) PLANO-CONVEX ROTMAN LENSES, AN ULTRA WIDEBAND ARRAY EMPLOYING A HYBRID LONG SLOT APERTURE AND A QUASI-OPTIC BEAM FORMER

(75) Inventors: Daniel F. Sievenpiper, Santa Monica, CA (US); James H. Schaffner, Chatsworth, CA (US)

(73) Assignee: HRL Laboratories, LLC, Malibu, CA (US)

( * ) Notice: Subject to any disclaimer, the term of this patent is extended or adjusted under 35 U.S.C. 154(b) by 6 days.

(21) Appl. No.: 10/773,942

(22) Filed: Feb. 6, 2004

(65) Prior Publication Data

US 2004/0207567 A1 Oct. 21, 2004

Related U.S. Application Data

(60) Provisional application No. 60/463,980, filed on Apr. 18, 2003.

(51) Int. Cl.
*H01Q 19/06* (2006.01)

(52) U.S. Cl. ..... 343/754; 343/909; 343/911 R; 343/770

(58) Field of Classification Search ..... 343/754, 343/911 R, 909, 753, 770, 767
See application file for complete search history.

(56) References Cited

U.S. PATENT DOCUMENTS

| | | | | |
|---|---|---|---|---|
| 3,761,936 | A * | 9/1973 | Archer et al. | 343/754 |
| 4,490,723 | A * | 12/1984 | Hardie et al. | 343/754 |
| 4,641,144 | A * | 2/1987 | Prickett | 343/754 |
| 5,329,248 | A * | 7/1994 | Izadian | 330/295 |
| 5,936,588 | A * | 8/1999 | Rao et al. | 343/754 |
| 5,952,966 | A | 9/1999 | Smith | 342/373 |
| 6,160,519 | A * | 12/2000 | Hemmi | 343/754 |
| 6,262,495 | B1 | 7/2001 | Yablonovitch et al. | 307/101 |
| 6,366,254 | B1 | 4/2002 | Sievenpiper et al. | 343/770 |
| 6,384,797 | B1 | 5/2002 | Schaffner et al. | 343/795 |
| 6,426,722 | B1 | 7/2002 | Sievenpiper et al. | 343/700 MS |
| 6,433,756 | B1 | 8/2002 | Sievenpiper et al. | 343/909 |
| 6,483,480 | B1 | 11/2002 | Sievenpiper et al. | 343/909 |
| 6,483,481 | B1 | 11/2002 | Sievenpiper et al. | 343/909 |
| 6,496,155 | B1 | 12/2002 | Sievenpiper et al. | 343/770 |
| 6,518,931 | B1 | 2/2003 | Sievenpiper | 343/770 |

OTHER PUBLICATIONS

Park, Y.J., and Wiesbeck, W., "Angular Independency of a Parallel-Plate Luneberg Lens With Hexagonal Lattice and Circular Metal Posts," IEEE Antennas and Wireless Progation Letters, vol. 1, pp. 128-130 (2002).

*Reference Data for Engineers: Radio, Electronic, Computer, and Communications*, Seventh Edition, Howard W. Sams & Company, pp 32-39 - 32-41 (1988).

* cited by examiner

*Primary Examiner*—Hoang V. Nguyen
(74) *Attorney, Agent, or Firm*—Ladas & Parry LLP

(57) ABSTRACT

A multiple slot antenna wherein the slots are arranged in a planar configuration and therein the antenna further comprises a plurality of plano-convex Rotman lenses disposed in a stack, each plano-convex Rotman lens in said stack having a major surface disposed at an angle to the planar configuration of the slots of the antenna, with planar portions of the each Rotman lens defining a portion of each one of the slots of the antenna.

25 Claims, 3 Drawing Sheets

Long Slot Array

Rotman Lens Beamformer

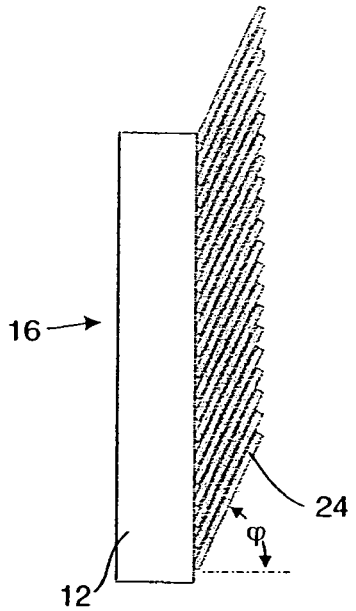
Figure 2c
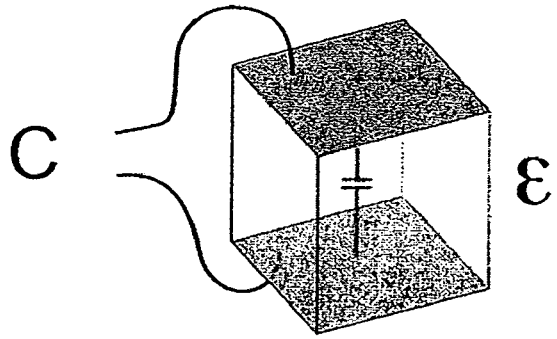
Figure 4
Fig 3a
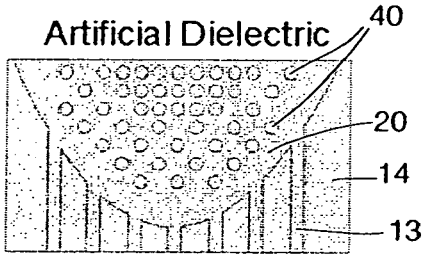
Fig 3b
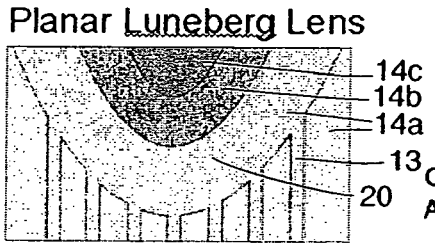
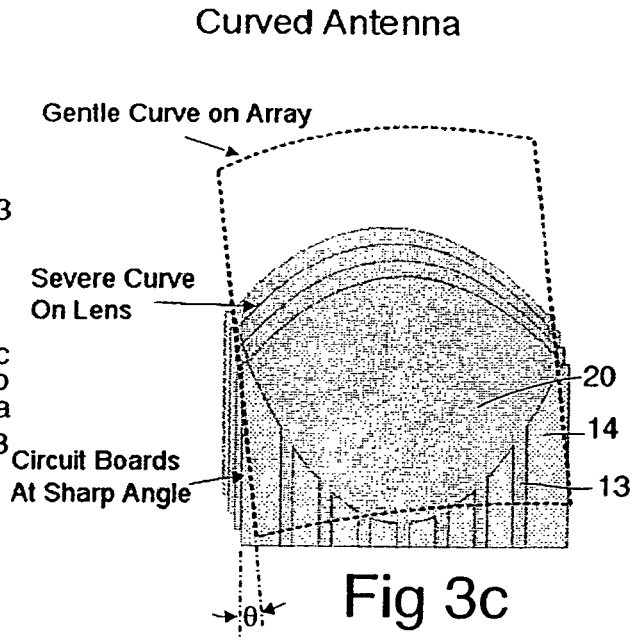
Fig 3c

PLANO-CONVEX ROTMAN LENSES, AN ULTRA WIDEBAND ARRAY EMPLOYING A HYBRID LONG SLOT APERTURE AND A QUASI-OPTIC BEAM FORMER

CROSS REFERENCE TO A RELATED APPLICATION

This application claims the benefit of U.S. Provisional Application No. 60/463,980 filed Apr. 18, 2003, entitled "Plano-convex Rotman Lenses, an Ultra Wideband Array Employing a Hybrid Long Slot Aperture and a Quasi-Optic Beam Former" the disclosure of which is hereby incorporated herein by reference.

TECHNICAL FIELD

The technical field of this disclosure relates (i) plano-convex Rotman lenses, (ii) new double convex Rotman lenses, and (iii) a new antenna and beam former, which is capable of ultra broad bandwidth (approaching 100:1) and beam switching.

BACKGROUND INFORMATION

Prior art antennas include:

(1) Flared notch type antennas, which are capable of somewhat broadband operation, but are typically limited to a bandwidth between 3:1 and 10:1. The antenna of the presently disclosed technology uses a long slot array that is capable of much broader bandwidth, approaching 100:1.

(2) Spiral antennas or log-periodic antennas, which are difficult to build into arrays because of their size. The result is that they have low aperture efficiency at high frequencies.

(3) Traditional phase shifters or true-time-delay elements. Phase shifters naturally cannot achieve broad bandwidth. True-time-delay elements can achieve broad bandwidth, but if an individual device is connected to each antenna, the resulting array is complex and expensive. The disclosed beam former uses a quasi-optical technique, resulting in a much simpler beam former.

(4) Traditional quasi-optical techniques. These are typically very large due to the need for lens-like structures. The disclosed quasi-optical technique uses a unique folded lens, so the resulting structure is much smaller.

(5) Parallel plate Luneberg lenses. See "Angular Independency of a Parallel-Plate Luneberg Lens With Hexagonal Lattice and Circular Metal Posts" by Yosang-Jin Park and Werner Wiesbeck, IEEE Antennas and Wireless Progation Lett., Vol. 1, 2002.

Artificial dielectric materials are also known in the art. See my U.S. patents:

(1) U.S. Pat. No. 6,518,931 "Vivaldi cloverleaf antenna"

(2) U.S. Pat. No. 6,496,155 "End-fire antenna or array on surface with tunable impedance"

(3) U.S. Pat. No. 6,483,481 "Textured surface having high electromagnetic impedance in multiple frequency bands"

(4) U.S. Pat. No. 6,483,480 "Tunable impedance surface"

(5) U.S. Pat. No. 6,433,756 "Method of providing increased low-angle radiation sensitivity in an antenna and an antenna having increased low-angle radiation sensitivity"

(6) U.S. Pat. No. 6,426,722 "Polarization converting radio frequency reflecting surface"

(7) U.S. Pat. No. 6,384,797 "Reconfigurable antenna for multiple band, beam-switching operation"

(8) U.S. Pat. No. 6,366,254 "Planar antenna with switched beam diversity for interference reduction in a mobile environment"

(9) U.S. Pat. No. 6,262,495 "Circuit and method for eliminating surface currents on metals"

the disclosures of which patents are hereby incorporated herein by reference.

This disclosed technology relates to antennas and beam formers, which are capable of ultra broad bandwidth (approaching 100:1) and beam switching. The disclosed antenna can achieve much broader bandwidth and smaller size than existing approaches by combining a broadband long slot aperture with a folded quasi-optical beam former. The disclosed antenna can be used for (i) broadband communication systems, such as impulse radio, (ii) broadband listening systems, or (iii) impulse radar. It can also be used in both military and civilian applications such as collision avoidance radar applications.

BRIEF DESCRIPTION OF THE DISCLOSED TECHNOLOGY

In one aspect the presently disclosed technology relates to a combination of a long slot array and a quasi-optical beam forming network, which are preferably constructed using printed circuit board technologies. The printed circuit boards can be arranged (folded up) so that the structure can be much smaller volume-wise than other quasi-optical approaches. The beam former involves several novel tens techniques, with the preferred approach including an artificial dielectric material.

In another aspect the presently disclosed technology relates to a multiple slot antenna comprising:

(a) a first plurality of cards defining a plurality of slots therebetween for radiating electromagnetic energy therefrom, each card having a conductive material layer formed at least one side of a dielectric material element, the conductive material layer on at least one side of each card in said first plurality of cards forming a plano-convex Rotman lens with a plurality of parallel conductors emanating therefrom;

(b) a second plurality of cards arranged with edges aligned orthogonally to the dielectric material elements in the first plurality of cards, the second plurality of cards having conductive material formed at least one side of a dielectric element, the conductive material on at least one side of each dielectric element of the second plurality of cards forming a convex-convex Rotman lens with a plurality of parallel conductors emanating therefrom; and (c) the plurality of parallel conductors emanating from the plano-convex Rotman lens on a given card in first plurality of cards mating with one of the parallel conductors emanating from each convex-convex Rotman lens in the second plurality of cards.

In yet another aspect the presently disclosed technology relates to a method of making an antenna element comprising:

a) etching a Rotman lens into each of a plurality of printed circuit boards, the etched Rotman lenses each having a plano-convex configuration with a planar edge of each etched Rotman lens being disposed adjacent and parallel to an edge of each of the printed circuit boards;

b) stacking the Rotman lens etched printed circuit boards in a stack with the planar edges of the etched Rotman lenses being adjacent a common edge of the resulting stack of Rotman lens etched printed circuit boards so that the planar edges of the etched Rotman lenses define a plurality of antenna slots; and c) resistively coupling the planar edges of the etched Rotman lenses to adjacently disposed planar edges of neighboring etched Rotman lenses at distal ends of the antenna slots.

In another aspect the presently disclosed technology relates to a plano-convex Rotman tens.

In still yet another aspect the presently disclosed technology relates to a double convex Rotman lens wherein the Rotman lens has a substrate with an effective dielectric constant, the effective dielectric constant of said substrate varying in a region immediately adjacent at least one end of the Rotman lens.

BRIEF DESCRIPTION OF THE DRAWINGS

FIGS. 2*a*–2*c* depict the present combined antenna aperture and beam former, in an expanded form (FIG. 2*a*) and a folded form (FIGS. 2*b* and 2*c*), respectively;

FIGS. 3*a*–3*c* depict several approaches for making the plano-convex Rotman lens structure;

FIG. 4 represents how artificial dielectrics can be built as a network of capacitors—since the dielectric constant of a volume of material can be determined by measuring its capacitance, one can embed capacitors inside the material and the effective dielectric constant is determined by the value and arrangement of these capacitors;

DETAILED DESCRIPTION

As used herein, the term "long slot" is intended to refer to the slot of a slot-type antenna that is much longer than a wavelength (λ) of the frequency of interest. For example, a slot having a length of 10λ is certainly a long slot.

As used herein, the term "quasi-optical" refers to the use of microwave radio frequency technology to mimic free space optical technology, such as lenses, mirrors, gratings, and the like.

The disclosed antenna may have ultra wide bandwidth (on the order of 100:1) and provides beam switching, yet it can be made much smaller volume-wise than alternative approaches. It achieves this performance by combining a non-resonant antenna aperture with a quasi-optical beam forming network, which provides true time delay across the aperture in two dimensions. Since the beam forming network is based on a lens-like approach, it is able to provide multiple simultaneous beams. Also, since the lens-like structure is preferably built using printed circuit board or other similar technology, it can be folded up into a volume that is much thinner than would otherwise be possible.

Figure 1A:
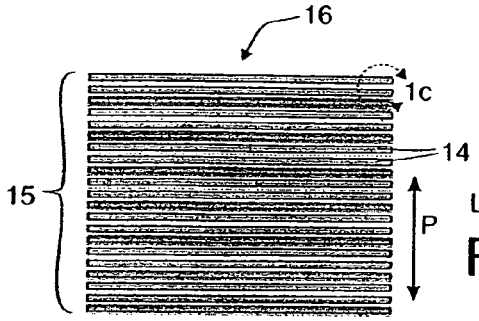
FIGS. 1*a* and 1*b* depict the basic concept of a stacked plano-convex Rotman lens with the planar end being arranged as a series of slot antennas, the view of FIG. 1*a* being an edge-wise view and the view of FIG. 1*b* being rotated by 90° to show the shape of the Rotman lens.
Figure 1B:
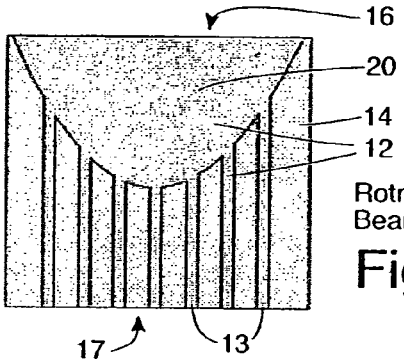
Figure 1C:
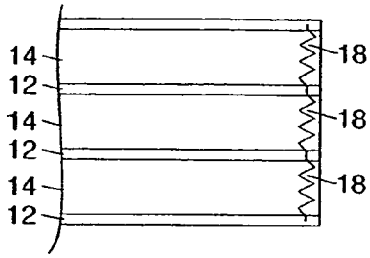
FIG. 1*c* is a detailed edge-wise view of the stacked plano-convex Rotman lens at a corner thereof.

The long slot array aperture and the basic concept behind the beam forming structure are shown in FIGS. 1*a*, 1*b* and 1*c*. Conventionally, a "long slot" is an opening in a metal sheet that is many wavelengths long at the frequency of interest. It is typically terminated with a resistor at each end of the slots to avoid the excitation of standing waves that would disturb the radiation pattern. An electric field is set up along the slot with a particular phase gradient (or in the present case, a time gradient) and radiates at an angle that is determined by this gradient. If the field is constant across the slot, then the wave radiates in the normal direction to the plane of the slot.

In the prior art, a slot is fed by numerous microstrip lines or other similar waveguides from the back side of the slot. The spacing of these lines must be close to ½ wavelength at the highest frequency of interest, because of the formation of undesirable grating lobes in the radiation pattern which will otherwise occur with a wider spacing.

The present beam former 10 comprises a metallic parallel plate structure, which naturally matches to the slot geometry, as each of the two parallel metallic plates 12 forms one side of the slot. This eliminates the need for individual feeds, so the effective feed spacing is infinitesimal. This design therefore increases the already large inherent bandwidth of a long slot array by increasing the limit on the high end of the operating band. It will still be limited by the spacing of the slots, but this can be made very small by using thin plate structures.

The beam former itself is a printed circuit lens structure. Structures like these are often known by the generic term "Rotman lens", but this structure is very different from a traditional Rotman lens. The current state of the art in this area involves a double-convex lens structure, that is printed as a parallel plate waveguide on a printed circuit board, or as part of a metal cavity. Ports on either side of the lens define the inputs and outputs. When a wave enters the lens through one of the inputs, it is distributed among the outputs on the other side of the lens with varying time delays that are defined by the shape of the lens. The outputs are typically connected to antennas, which form an array. Thus, this structure is a combination of a power divider and a true-time-delay element. Of course, it also works in reverse, so it can be used for transmit and receive. It can also be used for multiple simultaneous beams, since more than one input can be used.

There are other ways known in the art of imposing a time delay. However, a Rotman lens has an advantage of not requiring any active elements to perform its function. That means that a Rotman lens is an inexpensive solution compared to a solution which uses active elements to switch in and out different time delay elements.

The long slot antenna is naturally non-resonant and therefore supports a very broad bandwidth. Quasi-optical beam forming structures such as a Rotman lens also support a very broad bandwidth. While conventional Rotman lenses are double convex, the disclosed technology preferably utilizes a plano-convex Rotman lens so that the front planar surface (or near-planar surface) can provide the front of a long slot array. The entire structure should have low dispersion and broad bandwidth.

Figure 2A:
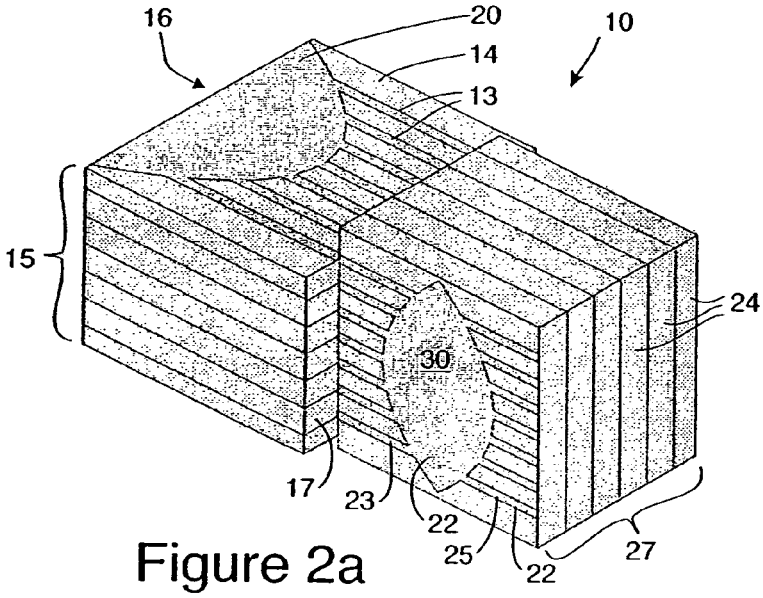
Figure 2B:
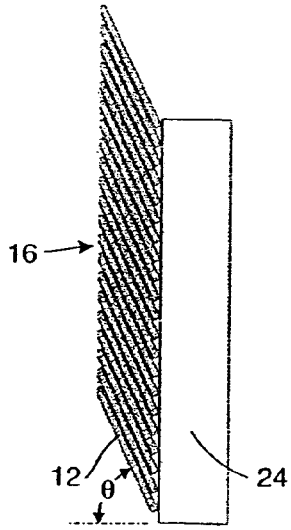

The design of the plano-convex Rotman lens preferably used with the present disclosed technology will be described below. This description will first focus on the physical design of the plano-convex Rotman lens and its ability to also function as a long slot array antenna. The disclosed plano-convex Rotman lenses, which are arranged in a stack-like configuration, provide one dimensional beam steering for the long slot array antenna. Two dimensional steering can be achieved by using a second set of Rotman lenses, as shown by FIGS. 2*a*–2*c*. The entire structure can be folded up, so that the circuit boards or cards defining the plano-convex Rotman lenses approach the long slot array at an angle other than 90° and the circuit boards or cards defining the second set Rotman lenses approach a rear surface of the first-mentioned set at an angle other than 90°, thus making the antenna and beam former much thinner than prior art devices.

FIG. 1*a* is an edge-wise view of a number of planar printed circuit boards or cards 14 arranged in a stack 15. Each board has a metallic layer 12, preferably copper, disposed on at least one major surface thereof, which layer 12 is preferably etched using conventional printed circuit board construction techniques to form the patterns described herein. When a number of boards 14 are arranged in a stack 15 as shown in FIG. 1*a*, the front edges 16 of the metallic layers 12 define the edges of a number of slots, with each slot being defined by the dielectric material 14 when the stack is viewed edge-wise as seen in FIG. 1*a*. Thus, the number of slots is preferably equal to the number of printed circuit boards 14 in stack 15 and the slots are all arranged in a planar configuration in this embodiment.

FIG. 1*b* shows how the layer 12 is etched in forming a plano-convex Rotman lens 20. The planar end is identified by the numeral 16. The planar end 16 forms the front edges of the array of long slots shown in FIG. 1*a*. Preferably, lenses 20 are built on printed circuit boards 14, which can be stacked up as shown by FIG. 1*a*. The printed circuit lenses 20 can be formed on either one or both major surfaces of printed circuit boards 14 and the boards can either be sandwiched closely together (as shown in FIG. 1*c*) or spaced apart (as shown in FIG. 1*a*). The dielectric material under the lenses 20 may be an artificial dielectric as is discussed more fully with reference to FIGS. 3*a* and 3*b*.

There is no particular need for the lenses 20 and other metallic elements 12 to be disposed on printed circuit boards 14 (although, as will be discussed, to realize the needed time delays for a Rotman lens, it is convenient to use a printed circuit board material as the preferred embodiment). The metallic elements 12, 20 form the active components of the beam former and the dielectric elements (the circuit boards 14) are present (i) to support the metallic elements in the disclosed configuration and (ii) since printed circuit board technology provides a convenient and inexpensive way of making the disclosed beam former.

FIG. 1*c* is an enlarged view of three printed circuit boards 14 and their associated metallic layers 12 at a corner of the beam former depicted in FIG. 1*a*. Resistors 18 are preferably connected at the ends of the slots between the adjacent metallic layers 12. The slots are defined by the exposed ends of the dielectric material of the printed circuit boards 14.

The resisters 18 preferably have a resistance equal to the characteristic impedance of the slot, which is about $$\frac{377}{\sqrt{E_{eff}}}\Omega,$$

where $E_{eff}$ is the effective dielectric constant of the material filling the slot.

The long slot array emits electromagnetic radiation from the front edges 16 of the slots with a polarization as indicated by arrow P (see FIG. 1*a*).

The front edges 16 of the printed circuit boards 14 define the long slot array, so that each printed circuit board is one slot (see FIGS. 1*a* and 2*a*). Coupled to the long slot array of FIGS. 1*a*–1*c* is a second portion of the beam former 10, the second portion being formed by a double convex Rotman lens 30, which is preferably formed by a second stack 27 of planar printed circuit boards 24 each having at least one metallic layer 22 etched as shown and described herein. The boards 24 in FIG. 2*a* are shown mating with the boards 14 of the long slot array at a right angle thereto. As has been mentioned, the boards 14, 24 can be folded to arrive at a more compact arrangement and, after folding, the stacks of boards 14, 24 will not necessarily end up being disposed at right angles to one another.

The lenses 20 of the long slot array have a series of parallel conductors 13 which extend from a rear edge of the lenses 20 towards a rear surface 17 of the long slot array on each printed circuit board 14 of the array to thereby define a two dimensional array of contact points at rear surface 17. These conductors 13 are laterally spaced on each printed circuit board 14 to (i) provide the number of beams required to cover a field of view (in one direction) of interest and (ii) mate with parallel arranged conductors 23 which extend forward from lenses 30 toward conductors 13 on each printed circuit board 24 the stack of printed circuit boards 27. Similarly, the spacing of the conductors 23 is selected to (i) provide the number of beams required to cover a field of view (in an orthogonal direction) of interest and (ii) mate with conductors 13 in the aforementioned two dimensional array. When the stacks 15, 27 of boards 14, 24 are disposed at a right angle to each other as shown in FIG. 2*a*, the lateral centerline spacings of the conductors 13 on each board 14 equals the centerline spacing of the boards 24 in stack 27 and the lateral centerline spacings of the conductors 23 on each board 24 equals the centerline spacing of the boards 14 in stack 15. The printed circuit boards 14 can be very thin and they also can be stacked at an θ angle to the surface 16 of the slot array, as shown in FIG. 2*b*. Similarly, printed circuit boards 24 can also be very thin and they can be stacked at an angle ϕ to the rear surface 17 of the slot array, as shown in FIG. 2*b*. This results in a more compact structure than would be achieved if the printed circuit boards 14, 24 remained normal to the face 16 of the array as is depicted by FIG. 2*a*.

Each conductor 13 mates with a corresponding single conductor 23 and these conductors are preferably soldered to each other where they mate at surface 17. Extending rearward from lenses 30 is a series of conductors 25 on each printed circuit board 24 in stack 27.

By building the quasi-optical beam former on printed circuit boards, and arranging them in angled stacks, as shown by FIGS. 2*b* and 2*c*, a much smaller antenna volume can be obtained than would be possible using prior art approaches. The design is also low-cost, because the primary component is preferably etched printed circuit boards. Of course, printed circuit boards 14, 24 need not be used and other means can be used to support the disclosed metallic structures or such structure could be self-supporting.

One unique aspect of the present disclosed technology is the plano-convex Rotman lens, shown in various forms in FIGS. 1*b*, 3*a* and 3*b*. A double-planar design could also be implemented, if desired. In either case, the dielectric material is preferably modified appropriately in order to obtain the delay times needed in the lens, as is explained below. One difference between this technology and the prior art technology is that at least one surface 16 of the Rotman lens is either flat (i.e. planar) or nearly flat or planar, so that it can define the long slot array. This cannot be done with a conventional parallel plate waveguide structure, because of the requirement that the time delay difference among the various outputs form a linear gradient. To achieve this linear gradient, an artificial dielectric material is preferably utilized that can be built into printed circuit boards using standard printed circuit techniques of etching and/or drilling.

The lens should be designed so that the time delay from each element has a constant gradient at the front of the lens. Since it preferably has a flat frontal edge 16, it is preferably optically denser in the center of lens 20. In the preferred embodiment, this is accomplished using an artificial dielectric, which consists of printed metal patterns, or metal particles embedded in or disposed on printed circuit boards 14 under the lenses 20 of the circuit structure. It can also be built using conventional dielectrics, such as the planar Luneberg lens. Another approach involves curving the front of the lens. Since the printed circuit boards 14 are preferably disposed at an angle θ with respect to the front 16 of the aperture, the curvature of the array is much less than the curvature of each lens, so the structure is still nearly planar, as can be seen by reference to the embodiment of FIG. 3*c*.

One way to make such an artificial dielectric material is to etch openings 40 into the metal lenses 20 on one or both sides of the board 14 (See FIG. 3*a*). As a wave passes through the parallel plate waveguide, its currents must travel a longer path because of the voids 40, so the wave effectively travels more slowly than it would if voids 40 were not present.

Another way to make an artificial dielectric is to drill or otherwise form holes or apertures 40 in the dielectric material 14 under lenses 20, so that the apertures 40 contain air voids or are filled with other material having a different dielectric constant than the bulk dielectric constant of material 14. If the air voids or other material in the apertures are much smatter in diameter than the wavelength of interest, the wave will feel a weighted average of the dielectric and air, and will travel faster than it would in a solid dielectric. By varying the effective dielectric constant across the area of the parallel plate waveguide, a lens can be built where waves from each input port create a time gradient across the long slot output port, thus forming a beam in a particular direction.

Numeral 40 in FIG. 3*a* can represent either voids in the metal layer forming lens 20 or voids in the dielectric material under lens 20 or a combination of the two.

The effective index of refraction, as a function of position, is designed so that the front edge 16 of the lens 20 may be flat, and the quasi-optical distance from any of the feeds 13 to the flat front surface 16 is constant, or forms a linear gradient across the flat front surface 16. Alternatively, the effective index of refraction is designed so that the optical distance from any of the feeds to an imaginary plane in front of the lens is constant, or forms a linear gradient on that plane. In the latter case, the front of the lens can be curved, as shown by the embodiment of FIG. 3*c*, which is discussed below.

The use of artificial dielectrics is the preferred approach, but there are other approaches that can achieve a similar effect. One is to use a planar Luneberg lens, which is shown in FIG. 3*b*. A Luneberg lens is traditionally a spherical structure with a dielectric constant that varies throughout its volume. Luneberg lenses are typically constructed as spherical shells using multiple dielectrics. One could use a similar shell-like approach, by building it in planes using thin sections 14*a*–14*c* of different dielectric materials under lens 20. Since the front surface 16 is preferably flat, and certainly not spherical, a different set of dielectric materials and shapes would be needed than used in conventional Luneberg lenses.

Another approach is shown in FIG. 3*c*, which involves using a traditional double-convex Rotman lens 20' (or a modified double-convex lens—see below). The front of a conventional double-convex Rotman lens 20' must have a fairly severe curvature (when the boards 14 are viewed in plan view). But given the fact that the circuit boards 14 are preferably disposed to the slot array at a sharp angle θ, the severe curvature of the front of the array would instead become a much more gentle curvature (since the board curvatures are then viewed from an acute angle θ to the plane of the boards 14 making the curvature then appear much more gentle). Since it would be gently curved (or even nearly flat), it would still be useful for many applications requiring conformal antennas. The curvature of the slot array and the curvature of the Rotman lenses could be adjusted by varying the tilt angle θ of the circuit boards.

The front surface of the slots of the antenna may well be curved due to the application in which it is used. For example, curved surfaces are rather common on the surfaces of aircraft and thus there wilt likely be embodiments of the antenna where the slots have some amount of curvature associated with them. In such applications the embodiment of FIG. 3*c* could prove quite useful. Moreover, instead of using a conventional double-convex Rotman lens 20', the lens 20' could instead be a modified version of the plano-convex lens described herein wherein the front surfaces of the boards 14 is curved less than is required for a conventional double-convex Rotman lens 20' but wherein the front surfaces of the boards 14 are not flat either. Instead the front surfaces of the boards 14 are gently curved by using artificial dielectric materials adjacent lenses 20' as previously discussed.

In all of these approaches, additional thin lens structures could be used outside of the circuit board array, in front of the slots, if required to achieve a uniform time gradient. The approach described herein does not rule out composite lens structures either inside or outside the circuit boards. The embodiments shown in the figures would be the most versatile, and the lowest cost. Since artificial dielectrics can be made using standard printed circuit board techniques, and can conceivably result in a flat structure, or a structure of any other desired shape, the preferred embodiment involves using artificial dielectrics to adjust the delay times in the Rotman lens to obtain the desired shape of its leading edge.

Other techniques used in artificial dielectrics include embedding metal particles within the dielectric, as schematically shown in FIG. 4. The basic concept behind these materials is that if one wants to determine the dielectric constant of the material contained within a volume, one can deposit metal plates on the sides of that volume, and measure its capacitance. By knowing the geometry of the volume, and the measured capacitance, one can determine the effective dielectric constant. If someone were to insert a capacitor inside that volume, then the measured capacitance from the outside would be different, and therefore the effective dielectric constant would also be different. One can also make similar adjustments to the magnetic permeability. By filling the volume between the parallel plate waveguide of lenses 20 with an effective dielectric material, which may be made either by adjusting the metal geometry, the dielectric geometry, or both, one can build a structure that acts as a lens by varying the effective dielectric constant throughout the volume so that the time delay from each input port (where conductors 13 meet lenses 20) forms a linear time gradient across the long slot output port. In this way, each input port will form a beam in a particular direction.

Figure 5A:
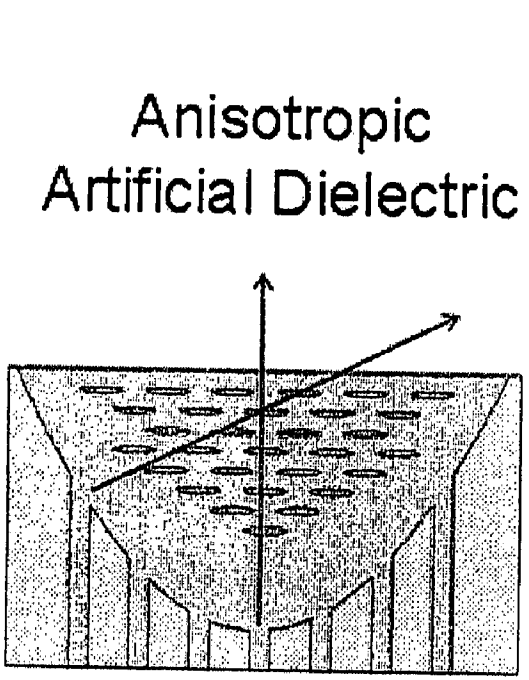
FIGS. 5*a*–5*c* demonstrate several techniques for achieving large scan angles.
Figure 5B:
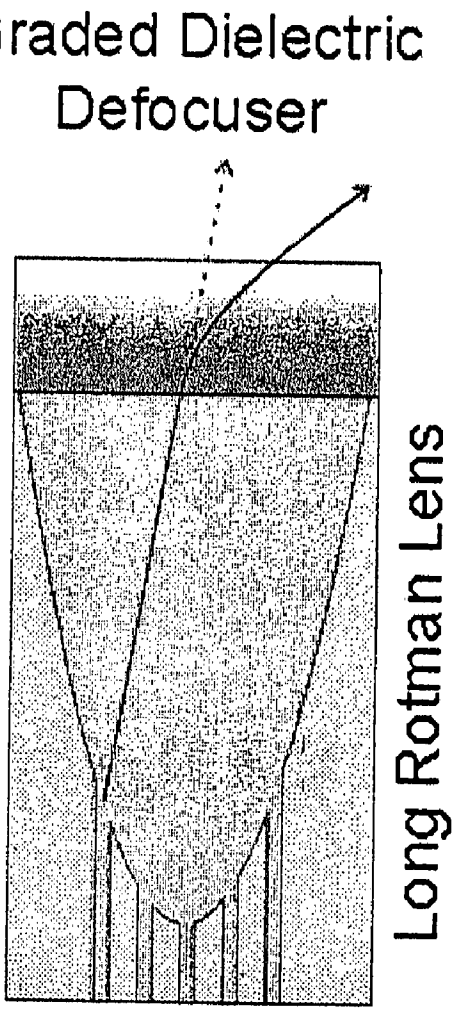
Figure 5C:
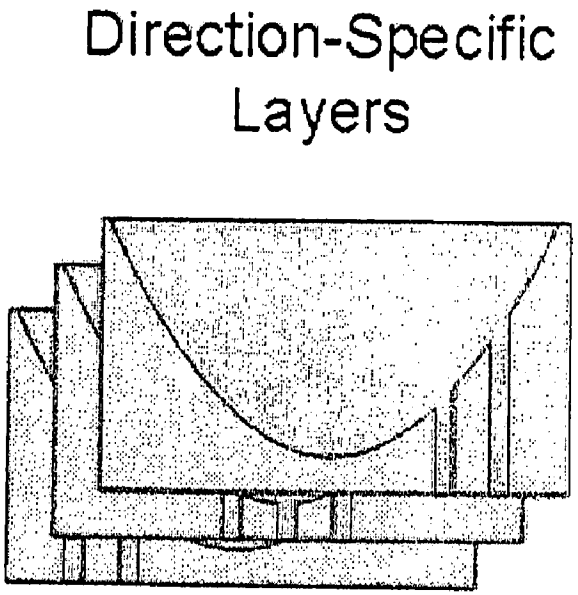

FIGS. 5*a*–5*c* demonstrate several methods of achieving large scan angles. By adjusting the geometry of the effective dielectric, one can make it isotropic, so that its properties are different for waves propagating in different directions. One can also make the lens very long, resulting in narrow scan angles, but then defocusing the beam with a graded dielectric layer. One could also use different layers for different sets of scan angles.

The design of lenses is often simplified by using the thin lens approximation, which assumes that the thickness of the lens can be ignored, and that all rays are impinging on an infinitesimally thin structure. Since this approximation is not valid for most compact structures based on our design, rays that approach the lens from a wide angle with respect to normal will not form a constant time gradient at the front of the aperture. This problem is exacerbated by the fact that the dielectric constant varies across the lens. In other words, a lens that is optimized for one angle may not be optimized for all angles. In order to correct this problem, anisotropic artificial dielectrics can be used, as shown in FIG. 5*a*. By definition, an anisotropic artificial dielectric has an effective dielectric constant that varies as a function of angle. This allows one to build a lens that is optimized for all angles, or for a greater set of angles. Using conventional artificial dielectrics, such a material can be built by varying the geometry of embedded metal particles so that their capacitance to their nearest neighbors is different in different directions, such as by stretching or compressing the lattice in one direction. In printed circuit effective dielectrics, it can be achieved by printing non-circular voids in the metal plates of the lens, or by drilling non-circular voids in the dielectric.

Other solutions to achieve wide scan angles are shown in FIGS. 5*b* and 5*c*. One could re-introduce the thin lens approximation by making the lens very tong, and only placing the artificial dielectric material at one end. This would result in a narrow range of scan angles, which could be corrected by using a graded dielectric defocuser. Such a material would have a slowly varying dielectric constant that would transition from high to low in the direction from the antenna to free space. This could be built into the circuit boards, or it could be a one-piece add-on to the aperture. Another solution to the problem would be to have separate layers that are each optimized for a small range of scan angles.

One could build a transmit/receive antenna using our combination aperture and beam former by using circulators or switches at each of the focal plane ports, that would direct energy to or from a power amplifier or a low-noise amplifier. One could also achieve scan angles that are not defined by the ports that are built-in to the lens, by feeding pairs or groups of ports with the appropriate phase or time delay between ports.

Having described this technology in connection with certain preferred embodiments thereof, modification will now suggest itself to those skilled in the art. For this reason, the disclosed technology is not to be limited to the disclosed embodiments, except as required by the accompanying claims.

What is claimed is:

1. A multiple slot antenna comprising:

(a) a first plurality of cards defining a plurality of slots therebetween for radiating electromagnetic energy therefrom, each card having conductive material layer disposed on at least one side of a dielectric material layer, the conductive material layer on at least one side of each card in said first plurality of cards forming a plano-convex Rotman lens with a plurality of parallel conductors emanating therefrom;

(b) a second plurality of cards arranged with edges aligned orthogonally to the dielectric material layers in the first plurality of cards, the second plurality of cards each having conductive material formed on at least one side of a planar dielectric element, the conductive material on at least one side of each planar dielectric element of the second plurality of cards forming a convex-convex Rotman lens with a plurality of parallel conductors emanating therefrom; and (c) the plurality of parallel conductors emanating from the plano-convex Rotman lens on a given card in first plurality of cards mating with one of the parallel conductors emanating from each convex-convex Rotman lens in the second plurality of cards.

2. The multiple slot antenna of claim 1 wherein the cards and the conductive material formed thereon are provided by etched printed circuit boards.

3. A multiple slot antenna wherein the slots are arranged in a planar configuration and therein the antenna further comprises a plurality of plano-convex Rotman lenses disposed in a stack, each plano-convex Rotman lens in said stack having a major surface disposed at an angle to the planar configuration of the slots of the antenna, with planar portions of the each Rotman lens defining a portion of each one of the slots of the antenna.

4. The multi-slot antenna of claim 3 wherein each plano-convex Rotman lens is disposed on a dielectric layer in said stack, the dielectric constant of each dielectric layer being artificially adjusted adjacent each Rotman lens in said stack.

5. The multi-slot antenna of claim 4 wherein the dielectric constant of each dielectric layer in the stack is artificially adjusted adjacent each Rotman lens in said stack by providing voids in the dielectric layers adjacent each Rotman lens in said stack.

6. The multi-slot antenna of claim 4 wherein the dielectric constant of each dielectric layer in the stack is artificially adjusted adjacent each Rotman lens in said stack by providing voids in each Rotman lens in said stack.

7. The multi-slot antenna of claim 3 wherein each Rotman lens in said stack has voids therein to adjust delay times in the Rotman lenses.

8. The multi-slot antenna of claim 3 wherein said angle is a 90° angle.

9. The multi-slot antenna of claim 3 wherein said angle is an acute angle.

10. An antenna comprising:

a long slot array; and a quasi-optical beam forming network constructed as printed circuit boards arranged in at least two stacks of printed circuit boards, each stack having a Rotman lens formed in a conductive layer associated with each printed circuit board, the Rotman lenses including conductors arranged such that the conductors of each Rotman lens in one stack each directly connect to a conductor associated with a different Rotman lens in another stack, the Rotman lenses of one stack defining edges of slots of the long slot array.

11. The antenna of claim 10 wherein the at least two stacks of printed circuit boards are arranged in a folded configuration with respect to one another.

12. The antenna of claim 11 wherein the slots are arranged in a planar configuration and wherein the Rotman lenses of one stack of printed circuit boards have a planar end which defines the slots.

13. The antenna of claim 12 wherein the at least two stacks of printed circuit boards are arranged in a folded configuration with respect to one another and with respect to the planar configuration of the slots.

14. The antenna of claim 10 wherein the slots are arranged in a planar configuration and wherein the Rotman lenses of one stack have a planar end which defines the slots.

15. A method of making an antenna element comprising:

a) etching a Rotman lens into each of a plurality of printed circuit boards, the etched Rotman lenses each having a plano-convex configuration with a planar edge of each etched Rotman lens being disposed adjacent and parallel to an edge of each of the printed circuit boards;

b) stacking the Rotman lens etched printed circuit boards in a stack with the planar edges of the etched Rotman lenses being adjacent a common edge of the resulting stack of Rotman lens etched printed circuit boards so that the planar edges of the etched Rotman lenses define a plurality of antenna slots; and c) resistively coupling the planar edges of the etched Rotman lenses to adjacently disposed planar edges of neighboring etched Rotman lenses at distal ends of the antenna slots.

16. The method of claim 15 wherein the etching of a Rotman lens into each of the plurality of printed circuit boards includes etching a series of parallel conductors extending from a rear edge of the Rotman lens towards a rear surface of the printed circuit board.

17. The method of claim 16 wherein the series of parallel conductors extending from a rear edge of the Rotman lens towards a rear surface of each of the printed circuit boards are disposed in different lateral locations on adjacently disposed printed circuit boards.

18. The method of claim 15 wherein the printed circuit boards each have a dielectric material, which has an effective dielectric constant, the effective dielectric constant of the dielectric material of each board being modified in a region in a vicinity of the planar edge of the Rotman lens by the provision of apertures in a metallic portion of the printed circuit board forming the Rotman lens.

19. The method of claim 15 wherein the printed circuit boards each have a dielectric material, which has an effective dielectric constant, the effective dielectric constant of the dielectric material of each board being modified in a region in a vicinity of the planar edge of the Rotman lens by the provision of apertures in a dielectric portion of the printed circuit board forming the Rotman lens.

20. The method of claim 15 wherein the printed circuit boards each have a dielectric material, which has an effective dielectric constant, the effective dielectric constant of the dielectric material of each board being modified in a region in a vicinity of the planar edge of the Rotman lens in a manner of a planar Luneberg lens.

21. A plano-convex Rotman lens wherein the Rotman lens has a planar end disposed confronting a convex end thereof.

22. The plano-convex Rotman lens of claim 21 wherein the Rotman lens has a substrate with an effective dielectric constant which varies in a region immediately adjacent the planar end of the plano-convex Rotman lens due to apertures in the substrate in said region.

23. The plano-convex Rotman lens of claim 21 wherein the Rotman lens has a substrate with an effective dielectric constant which varies in a region immediately adjacent the planar end of the plano-convex Rotman lens due to apertures in a metal layer associated with said region.

24. A double convex Rotman lens wherein the Rotman lens has a substrate with an effective dielectric constant, the effective dielectric constant of said substrate varying in a region immediately adjacent at least one end of the Rotman lens.

25. The double convex Rotman lens of claim 24 wherein the Rotman lens has two convex ends, with one convex end being less convex than the other end and wherein the region with the varying effective dielectric constant is immediately adjacent said one convex end which is less convex than the other end of said Rotman lens.

* * * * *